United States Patent [19]

Godwin

[11] 4,173,346

[45] Nov. 6, 1979

[54] BOARD-TYPE GAME SIMULATING FOOTBALL GAME

[76] Inventor: William D. Godwin, 2812 Roswell La., Columbus, Ga. 31906

[21] Appl. No.: 824,449

[22] Filed: Aug. 15, 1977

[51] Int. Cl.[2] ..... A63F 3/00

[52] U.S. Cl. ..... 273/247; 273/94 R

[58] Field of Search ..... 273/94 R, 247

[56] References Cited

U.S. PATENT DOCUMENTS

| | | | |
|---|---|---|---|
| 563,767 | 7/1896 | Holland | 273/247 |
| 1,522,714 | 1/1925 | Dietze et al. | 273/93 R |
| 1,537,605 | 5/1925 | Hansen | 273/94 R |
| 1,538,807 | 5/1925 | Head | 273/94 R |
| 1,614,681 | 1/1927 | Conley | 273/94 R |
| 1,992,475 | 2/1935 | DeHart | 273/247 |
| 2,743,105 | 4/1956 | Westbrook | 273/94 R |

*Primary Examiner*—Anton O. Oechsle
*Attorney, Agent, or Firm*—James B. Middleton

[57] ABSTRACT

The disclosure is a board-type game simulating a football game. A player is given the choice of a running play, or a passing or trick play, by selecting either to draw from a deck of cards or to roll a pair of dice, the wording on the cards and the use of the dice being statistically weighted to simulate the results of a conventional football game. The manner of use of the dice changes with changes in the condition of the game, and two decks of cards are provided for two different conditions of the game. Timing of the segments of the game is achieved by apparatus for counting the "possessions" of each team, a fixed number of possessions for each team determining one quarter.

2 Claims, 2 Drawing Figures

BOARD-TYPE GAME SIMULATING FOOTBALL GAME

Figure 1:
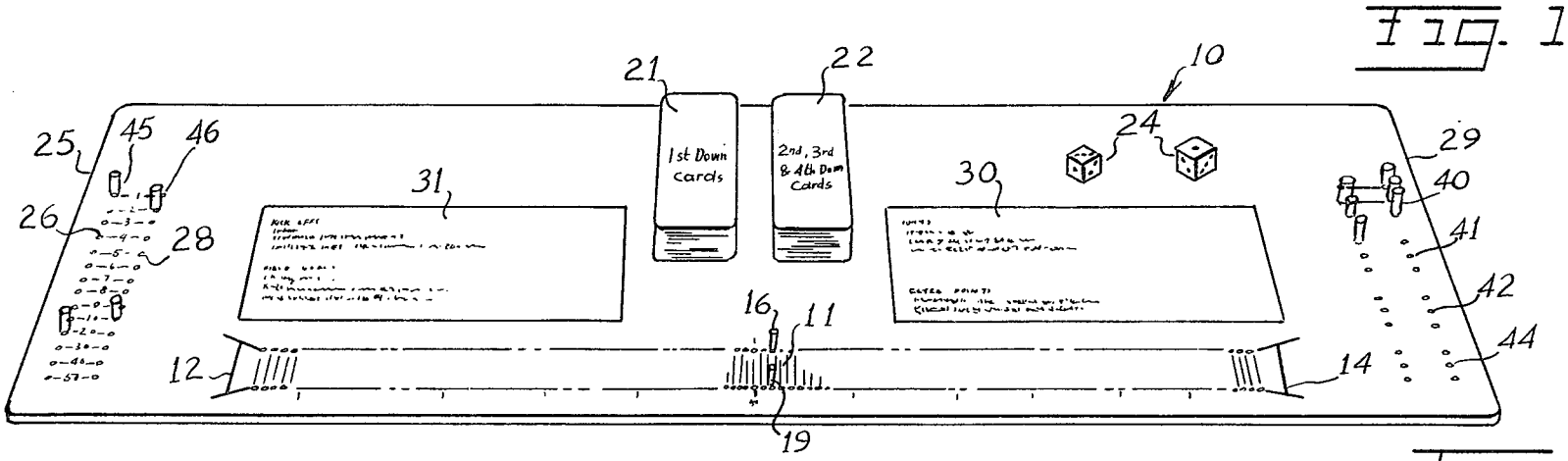

This invention relates to board games and the like, and is more particularly concerned with a board game simulating the game of football.

The game of football is one of the most popular games in the United States, and many people enjoy the game for various reasons even though they do not, or can not, play the actual game. Also, many people may wish to attend football games and/or watch games of football on television because of the social aspects of attending a game or watching a game in a group. Many such people, however, have so little knowledge of the game of football that they cannot enjoy the game. Even though a person may know the basic rules of football, it is extremely difficult to comprehend the reasons for various plays, or various strategic devices, employed in a game of football without being personally involved in a game of football. As a result, a person who cannot play football, or who does not wish to play an actual game of football, finds it very difficult to understand the reasons behind the strategy of a football team, and fails to appreciate the skill involved in choosing the right strategy to win a game.

In the past there have been numerous indoor games, or board games, intended to simulate a game of football. Almost all of these games include generally a simulated football field having various yardage markers thereon, and including some movable piece to indicate the position of the ball on the playing field. The difficult aspect of a football game, however, is to provide some means to allow a player to use strategy similar to the strategy used in the actual game of football, and for that strategy to yield similar results. Many of the prior art football-like games attempt to introduce strategy into the game, but the means to provide the strategy require such a great variety of spinners, cards, playing pieces and the like that the players must concentrate on the apparatus of the game in order to play the game, to the detriment of the strategic planning that should be the essence of the game. Other prior art football-like games are arranged so that the players of the game become more concerned with the simulated football players, their names, positions, and the like, or with some form of mechanical gimmick, that the players lose sight of the strategy that is supposed to be involved in a proper football game.

The present invention overcomes the above mentioned and other difficulties with the prior art football games by providing a game board simulating a football field and having a plurality of positions thereon, and means at each of the positions for receiving a marker. In order to move the marker, which is the representation of the football in the game of football, a player has a choice of two random selecting means, one random selecting means indicating a first general form of play in football (for example a running play), and the other random selecting means indicating a different general form of play in football (for example a pass or the like). Because the overall strategy in a football game varies with the progress with the game, there is a third random selecting means for use at a certain point in the progress of the game, the player again having the choice of only two random selecting means. Furthermore, the valuation given to the indications on the first random selecting means is varied by chart means in accordance with various conditions during progress of the game to achieve realism in the selection of strategy, and in the results of the selection.

To achieve realism in the length of the game to be played without the necessity for time clocks and the like, yet to be fair to both sides, the length of the present game depends on the number of "possessions" of each team. Thus, when each team has had the ball a certain number of times, one quarter is over; than, when four quarters have been completed, the game is ended. This, again, creates realism in the play of the game in that one team may keep the ball a short time and fumble frequently, thereby losing possession of the ball, so that the team had the ball the appropriate number of times but simply did not score. Alternatively, one team may have possession of the ball and, due to proper strategy, keep the ball and run for a touchdown or obtain a score by other means. Due to this means of timing the game, it is also possible that one team may have possession of the ball for an extended length of time while moving the entire length of the field, simply gaining first downs a great number of times until a touchdown can be made.

Figure 2:
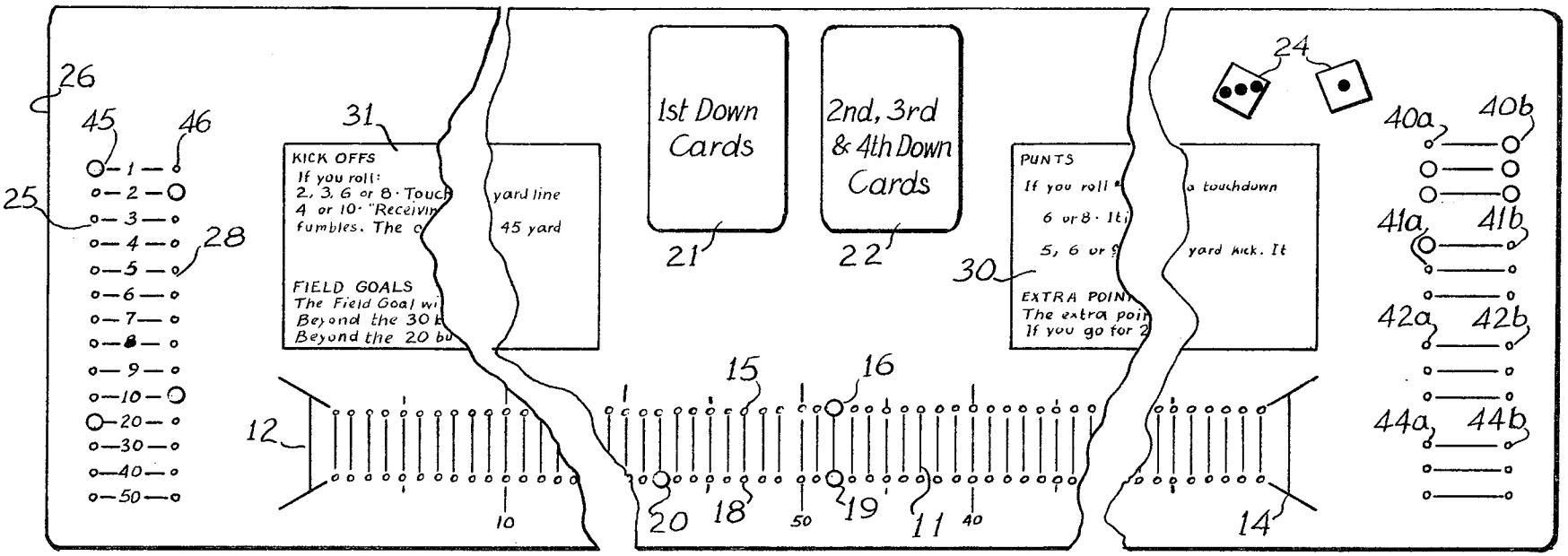

These and other features and advantages of the present invention will become apparent from consideration of the following specification when taken in conjunction with the accompanying drawing in which:

FIG. 1 is a perspective view showing a game apparatus made in accordance with the present invention, the game apparatus being set up for play; and, FIG. 2 is an enlarged plan view, partially broken away, showing the game of FIG. 1.

Referring now and more particularly to the drawing, and to that embodiment of the invention here chosen by way of illustration, it will be seen in FIG. 1 of the drawing that the game apparatus includes a generally rectangular board 10 having a representation of a football field shown at 11, with the two goal posts indicated at 12 and 14. As will be discussed in more detail hereinafter, there is a first plurality of holes generally indicated at 15 for receiving a marker 16 to indicate the position of the ball for the football. There is a parallel row of holes 18 for receiving a pair of markers here indicated as 19 and 20 for indicating the yardage required for a first down.

Substantially centrally of the board 10, and along the opposite edge thereof, there is a pair of decks of cards 21 and 22; and, there is shown a pair of dice at 24. The dice 24, along with the decks of cards 21 and 22, constitute the random selecting means which will be discussed in detail hereinafter.

In order to keep the score as the game progresses, there is a plurality of holes 25 along the left hand edge 26 of the board 10 for receiving a pair of markers, and another row of holes 28 receives a similar pair of markers for keeping the score of the opposite player.

To determine the progress of the game (which is a substitution for the time clock utilized in the conventional football game) there is a plurality of groups of holes adjacent to the right hand end 29 of the board 10. These groups of holes are shown in more detail in FIG. 2 of the drawing, and will be discussed in more detail hereinafter.

Looking now more particularly to FIG. 2 of the drawing it will be seen that the football field indicated at 11 has a grid printed to indicate the yardage lines, and one hole of the plurality of holes 15 is at each of the yardage line. Since the conventional football field is 100 yards from one end to the other, the present embodiment of the game has 100 holes constituting the plurality of holes 15, with 100 grid lines to make up the field 11. As a result, the peg 16, which indicates the ball for the football game, can be placed anywhere along the field 11 in one-yard increments.

The location of the ball 16 is one important aspect of the football game, but the placement of the ball is very important with respect to the line to be reached in order to gain a first down. In an actual football game the officials normally have a chain or the like that is ten yards long so that one end of the chain indicates the point to be reached by the team in order to gain a first down. The apparatus of the present invention simulates the ten-yard chain by providing the row of holes 18, the row of holes being provided with a pair of pegs 19 and 20, the pegs 19 and 20 being placed ten holes apart, or the equivalent of ten yards apart. Thus, when a player first takes possession of the ball, or when a player has just made a first down, one of the pegs (for example the peg 19) would be placed on the same grid line as the ball 16, then the other peg (for example the peg 20) would be placed ten holes away from the peg 19 in the direction the player is trying to move to reach the goal for a score.

The foregoing sets forth the indication for the ball, and the ten markers to show when the player has made a first down. The next point to be considered is how one moves the ball. The means for moving the ball, generally, includes the dice 24 along with the cards 21 and the cards 22. These will be discussed in detail below.

Considering first the dice 24, it will be understood that the usual arrangment is for a player to roll the dice, and to move the number indicated on the dice. In attempting to play a simulated football game, however, such a system would be completely chance, and would in no way represent, or even be commensurate with, an actual game of football. Such a system would tend to overlook the fact that a football game includes a defensive team as well as the offensive team.

As the game according to present embodiment of the invention is designed, the use of the dice 24 represents a running play in a football game. A running play is difficult in that one team member attempts to carry the ball while the entire opposite team attempts to block the advance of the ball by one means or another. Thus, if a player advances the ball by the number of yards shown on the dice there could easily be high yardage gains in complete opposition to the realities of a football game that includes two teams.

In the present game, when a player rolls the dice, which indicates that he is making a running play when the player is on his first, second or third down, the player rolls the dice and moves the number of yards shown so long as the indication on the dice is six or less; however, if the number indicated by the dice is above six, the player must subtract six from the indication and move the resulting number of yards. This simple device prevents a run-away game by the offensive team.

Those familar with the actual game of football will realize that since a team has four downs, or four chances, to gain ten yards in order to have another first down and another four tries, the entire situation is somewhat different when a team is making its last, or fourth, effort to make the ten yards. The team on the offense, or the team having the ball and trying to make the ten yards, is especially tensed up and will be trying especially hard to make the last yards needed so that the offensive team is going to be trying its very hardest on the fourth down. On the other hand, the defensive team knows that if they can hold the offense and prevent the gaining of ten yards, the defense will have the ball and have the opportunity to try to score. As a result, the defensive team will be trying especially hard to hold the offense within the ten yards. Given this special situation, it will be understood that the offense tends to gain very few yards, frequently is thrown for a loss of yards, but may pass or the like for some gain. Since a roll of the dice indicates a running play, in order to simulate this special condition on the fourth down, when the number indicated by the dice is below six, six is subtracted from the number rolled to give a minus yardage, number of yards lost by the offensive team. When the number indicated by the dice is above six, six is subtracted from the number as before to indicate a number of yards gained; however, it will be understood that very few yards can be gained by using such a technique.

Another condition that occurs in the game of football is the condition wherein the offensive team is on the fourth down, and has lost yards in one or more plays so that the offensive team has, perhaps, fifteen or twenty yards to go to make a first down. In this situation, one device used in football is for the offensive team to try to kick the ball to achieve great distance and require that the opposite team take over the ball close to their goal. In order to simulate this condition in the present game, the offensive player simply states that he is going to "punt", then he rolls the dice. The indication on the dice then is translated by a chart 30 to determine what happened. Similarly, if a team attempts to kick a field goal, the technique in the present game is to roll the dice and use the appropriate chart, such as the chart 31, to translate the indication on the dice into the result for the team. This same technique is used for the kick off, and for the extra points after a touchdown is scored.

It will therefore be seen that the dice 24 constitute one random selecting means for determining the progress of the game. Rather than the conventional direct use of the number indicated, however, the indication on the dice is manipulated depending on the condition in the game. Thus, in determining yards gained on a first down running play, a factor is subtracted from numbers over 6. It should be understood that the particular numbers used have been found to provide a playable game, but the invention is not limited to the use of the number 6. Rather, the inventive aspect is the taking of a function of the number indicated, the particular function resulting in realistic results for the given condition. For example, the function varies for fourth down plays, for the "blitz" rule to be discussed hereinafter etc. Other such functions of the indication may also be used to provide the requisite playability and desired results.

In addition, chart means such as charts 30 and 31 are used as means to vary the indication on the dice 24. The charts are designed with the desired statistical weighting to provide realistic results comparable to a conventional football game. Those skilled in the art will understand that the mathematical probability of any number possible on the dice can be determined, and a chart can then be made to provide certain results within a given probability. While certain specific examples of types of charts are discussed in conjunction with the embodiment of the invention here presented, it will be understood that additional charts, or different charts, may be provided for various conditions in the progress of a game.

In order to lend some additional interest to the game, and to introduce excitement beyond the roll of the dice, a second random selecting means comprises a deck of cards. While it is possible that only one deck of cards can be used, the present game utilizes two separate decks in order to simulate two separate conditions.

First it should be understood that the decks of cards in the present game are used when a player wishes to pass, that is to throw the ball to another player, or to utilize some form of trick play. Once this condition is set up, it will be understood by those skilled in the art that a team would not normally use a passing play, or some trick play, when the team is on its first down. Obviously, when the team is on only its first down, it has three additional tries to make the ten yards. As a result, the team would tend to be somewhat conservative on the first try and would tend towards a running play. As a result, if the team does in fact try a passing play on the first down, the defensive team is not truly prepared to defend against such a play and the offensive team is more likely to succeed in its effort. Conversely, after the first down, and on the second, third and fourth downs, the defensive team is prepared for passes and various trick plays so that the plays do not have as great a chance for success, or completion by the offensive team.

Thus, two separate decks of cards are used, one deck being for the first down plays, and the other deck being used for the second, third and fourth down plays. Each of the decks of cards is weighted statistically to achieve realism in the game. The first down cards, therefore, have approximately 60% of the cards favoring the offense wherein the play attempted is completed in favor of the team with the ball, and about 40% of the first down cards are against the offense wherein the offense does not successfully complete the play. The second, third and fourth down cards are reversed in that 40% of the cards are in favor of the offensive team, and 60% of the cards are against the offensive team. It will be remembered that this comports with the real game of football wherein the passing play on the first down takes the defensive team by surprise and it is more likely that the offensive team will be successful, and the passing play is expected on the second, third and fourth downs so that the defensive team is prepared and the defensive team will be more likely to be successful.

In the conventional game of football, in order to determine the length of the game, a time clock is used, the clock running so long as the game is being played, and stopping when the game is temporarily stopped. Such a system would be difficult in a board type game because the "play" of the game is simply the rolling of the dice or the drawing of a card so that one would not know when to run the clock and when not to. In addition, the provision of a clock with a game such as the game made in accordance with the present invention would tremendously increase the cost of the game, in many cases making the game economically prohibitive. Furthermore, the provision of a clock with the game would simply be an additional mechanical device that would tend to render the game too complex and too burdensome to be enjoyable. While many games use a fixed score to indicate the end of a game, such that when one player achieves a certain score the game is ended, such a device would in no way resemble a football game. In the game of the present invention, the game is divided into quarters by counting each player's possessions of the ball. Thus, when one team has the ball and moves down the field for some distance and loses the ball, that team has had one possession and the other team takes over the ball. The second team then may move down the field some distance and lose the ball so that the second team has had one possession. As the present game is designed, when each team has had the ball three times, or three possessions for each team, one quarter of the game is over. By the use of this device, neither of the players has an unfair advantage over the other especially since a player that makes a touchdown must kick the ball to the opposite player giving the opposite player a possession of the ball.

Looking at the right hand end of the board 10, it will be seen that there are 4 groups of holes indicated at 40, 41, 42, and 44. Each of the groups of holes comprises two rows of three holes each. The group of holes 40 thus has three holes **40*a*, and three holes 40*b*. Similarly, the group of holes 41 has three holes 41*a* and three holes 41*b*. The holes 40*a*, 41*a* etc., would be for one of the players, or one team, and the holes 40*b*, 41*b***, etc., would be for the opposite player or team.

In playing the game, in order to keep up with the possessions of the ball to measure the passage of the game, one starts with a peg in each of the holes **40*a* and a peg in each of the holes 40*b*. When the first player has had a possession and gives up the ball to the other team, the first peg in a hole 40*a* would be moved to a hole 41*a* indicating that the player using the holes a has had one possession. When the opposite player gives up possession of the ball so that he has completed one possession, one of the pegs in the holes 40*b* would be moved to one of the holes 41*b*. It will be seen by this technique, when both of the players have had three possessions each, there will be no pegs in any of the holes 40*a* or 40*b*, but there will be pegs in all of the holes 41*a* and 41*b*. For the second quarter, the procedure is repeated and the pegs are moved from the holes 41*a* and 41*b* to the holes 42*a* and 42*b* etc. When the pegs are taken from the last group of holes, the group 44**, the game is over.

Though many forms of scoreboard may be used in the present game, the scoring device shown at 28 is one very simple form of score keeping device. It will here be seen that there is a first row of holes 45 and a second row of holes 46. The two rows of holes are numbered from 1 to 9, then are numbered 10, 20, 30, 40, and 50. As a result, one can use two markers appropriately placed to indicate virtually any score that would be required in a football game. For example, when one touchdown is scored, a peg would be placed in the hole labeled 6. If the extra point is "made" the peg would be moved to the hole labeled 7. If another touchdown is scored by the same team, the score would be 13 so that one would put a peg in the hole labeled 10 and a second peg in the hole labeled 3. Such a scoring technique is well known and no further description is thought to be necessary.

From the foregoing description, the manner of playing the game should be understood by those skilled in the art. It is comtemplated that the dice would be used as the means for determining which player has the election whether to kick off or to receive the ball. Each player would throw the dice, and the player having the higher number on the dice would have the election. For purposes of this example, we shall assume that the player rolling the higher number elected to receive the ball.

The next step would be for the player kicking-off to the receiving player roll the dice. The indication on the dice is then compared with the kick-off chart to determine what happens to the ball. In general, as in conventional football, the chart would state that if certain numbers are indicated by the dice, the ball is received and run out to a certain line on the football field 11. It should be understood however that the chart may indicate that the receiving team fumbles the ball and it is recovered by the defense, or that the receiving team receives the ball and runs the full length of the field for a touchdown. Thus, the simple random selecting means of the pair of dice can be used in this condition with the indication being modified by the chart, to indicate a great variety of possible happenings, or results, in the progress of the game.

The usual next step is that one team has the ball and is ready to try to move the ball down the field, first, to have a first down, ultimately of course to score. Assuming for purposes of the illustration that the offensive team has just made a first down, so that the team has ten yards to go for the next first down, the offensive team has the choice of a running play or a passing or trick play. If the offensive team elects to throw the dice, this is a running play and the player would gain a number of yards shown by the dice if the number is six or below, and would gain the number of yards shown by the dice, less six, if the number shown by the dice is above six.

At this point it should be understood that, in order to add further interest to the game and further variety, certain numbers indicated by the dice can be very special happenings. For example, a double three, which would normally be a gain of six yards, may indicate that the offense fumbles the ball, recovers his own fumble but makes no gain at all. The roll of an 11 can indicate an 11 yard gain rather than the five yard gain that would be obtained by the usual rules; the roll of a 12 may be counted as a fumble in which the offense loses the ball to the defense. Again, since all of these events happen in a conventional game of football, the use of such devices renders the game much more realistic and puts a player on guard for the unusual things that happen in the game of football. Such modifications are contemplated within the statement that one takes a function of the indication rather than the direct indication of the dice.

Nevertheless, returning to the foregoing example, if the player on his first down decides to roll the dice, the things just discussed are the possibilities. Alternatively of course, the player may decide to try a passing play or some trick play. In this event, the player would draw one of the first down cards 21. The player would therefore draw a card 21 instead of rolling the dice 24 and would follow the instructions on the card. It will be remembered that the first down cards 21 are weighted statistically so that 60% of the cards favor the offense and 40% of the cards favor the defense. As a result, when the player draws a first down card, the card may say that he gains 26 yards or the card may say that he loses 10 yards. The card may even say that the offense loses the ball, the defense gains the ball and the defense makes a touchdown. It will therefore be seen that the cards can state any situation that may be encountered in a conventional football game.

While there is no specific number of cards necessary to the game of the present invention, it has been found that too few cards tends to limit the versatility of plays so that the passing and trick plays become somewhat uninteresting. Since the passing and trick plays are the more exciting part of the football game, rather than routine running plays, too few cards tends to limit the interest in the entire game. It should be obvious that too great a number of cards would, in the first place, be extremely unhandy simply from the standpoint of keeping up with the cards, and in the second place would tend to be repetitive or would have situations so similar that the cards would at least seem repetitive. Thus, while the number of cards is subject to considerable variation, it has been found in one successful embodiment that 50 cards in each of the two decks 21 and 22 provides a very playable game that has significant interest and variety.

Returning again to the example, when the player makes his choice between the first random selecting means and the second random selecting means, one way or another he would theoretically move the ball, or move the peg 16 which indicates the ball. For the sake of the example we shall assume that the player rolled the dice, or made a running play, for a gain of 5 yards. The player therefore did not make a first down, nor did he lose the ball; as a result, the same player must again try to advance. Once more, the player has the choice of trying a running play or trying a passing or trick play; once more, the player has the choice of rolling the dice or drawing a card, but this time he would draw one of the cards 22. The play would thus continue with the player either rolling the dice or drawing a card until the fourth down. At the fourth down, it should be remembered that a roll of the dice is interpreted differently in that 6 is subtracted from numbers on the dice that are under 6 so that the player may lose yardage.

On the fourth down, depending on the player's evaluation of this position, a player may decide to punt. If a player does decide to punt, he must say so, then roll the dice. The indication on the dice is compared with the chart 30 to determine the outcome. Again, the chart 30 may indicate a number of yards gained, it may indicate loss of the ball to the opposing team, or it may indicate a touchdown by either one of the teams.

To progress with the game, if we assume that a player reaches the goal line, the player makes a touchdown and makes six points. The conventional football game then allows the team making the touchdown to try for an extra point. The team may try for one point, in which case the team would try to kick the ball between the uprights of the goal post, or the team may try for two points in which case the team would try to run the ball over the goal line again. The making of the extra point is therefore another condition, and the dice are again used as the random selecting means in this condition. The player states whether he wishes to try for the one point or the two points, then rolls the dice. The indication on the dice is compared with the appropriate chart in order to determine if the player made his points or not.

One further condition that sometimes arises in a conventional football game is referred to in the vernacular as "blitz". The usual situation is that the offense has the ball very close to the opponents goal, and perhaps very close to making a first down. In such a situation, the defense may be somewhat desperate to hold the offense to small gains and may therefore be willing to make a large gamble. The gamble in the conventional football game is to muster all the force possible close to the line of scrimmage to prevent motion of the offense. The danger of such a technique is that, if the offense gets through the defensive line, the offense may be completely free and score very easily.

In order to simulate this condition in the game of the present invention, the defensive player would simply call "BLITZ!" On the calling of "blitz", when the offensive player rolls the dice, if the dice indicate the number 7 or the number 11 the offense makes a touchdown. On other numbers, the rules for fourth down apply even though it may be only first down for the offensive team. It will therefore be seen that this closely simulates the conventional football game wherein the offensive team may be held to extremely short yardage gain, or may be thrown for a loss. However, the offense may make a touchdown if it can break through the strong defense of the defensive team.

It will therefore be seen that the game of the present invention provides a highly playable game that closely simulates the conventional game of football in the strategy of the game, and in the chances of scoring in the game. All of the usual hazards are present through the devices of defining certain conditions, using the dice as a random selecting means in the various conditions but changing the result for a given indication for the different conditions by the use of various functions of the number indicated. Also, in many of the situations that arise in the football game, the player has the choice of defining certain conditions, such as "punt", in which he may use the one random selecting means; or, the player may simply elect a running play or a passing play which is to say that the player will maintain one condition and simply make his election as to a first random selecting means or a second random selecting means in order to make the game progress.

It will of course be understood by those skilled in the art that the particular embodiment of the invention here chosen is by way of illustration only and is meant to be in no way restrictive; therefore, numerous changes and modifications may be made, and the full use of equivalents resorted to, without departing from the spirit or scope of the invention as defined by the appended claims.

I claim:

1. A football game apparatus for simulating a game of football and including a board representing a football playing field and having a plurality of locations indicated thereon, first marking means representing a football, a first goal towards which a first player having possession of said football attempts to move said football, a second goal towards which a second player having possession of said football attempts to move said football, a plurality of random selecting means for indicating plays for determining movement of said football through said plurality of locations, and means for determining segments of the game comprises a first counting means for counting the times said first player has possession of said football, said first counting means including a first plurality of pegs, a first plurality of groups of holes defined in said board for receiving said first plurality of pegs, each group of holes of said plurality of groups of holes representing one of said segments of the game, and a second counting means for counting the times said second player has possession of said football, said second counting means including a second plurality of pegs, a second plurality of groups of holes defined in said board for receiving said second plurality of pegs, said second plurality of groups of holes being generally parallel to and aligned with said first plurality of groups of holes, each group of holes of said second plurality of groups of holes representing the same segment of the game as the adjacent group of said first plurality of groups of holes.

2. A football game apparatus as claimed in claim 1, further characterized in that a first random selecting means of said plurality of random selecting means comprises a pair of dice having numbers indicated thereon, and a second random selecting means of said plurality of random selecting means comprises a pair of decks of cards, said pair of dice constituting means for indicating running plays as attempts to move said football, and said pair of decks of cards constituting means for indicating passing and trick plays as attempts to move said football, a first deck of cards of said pair of decks of cards and said pair of dice being selectively useable for a first attempt to move said football in a group of attempts to move said football, and a second deck of cards of said pair of decks of cards and said dice being selectively useable for a second and subsequent attempts to move said football in said group of attempts to move said football.

* * * * *